United States Patent [19]

Cuddy et al.

[11] 3,998,666

[45] Dec. 21, 1976

[54] SUBSCALE REACTION STRENGTHENING OF LOW CARBON FERROUS METAL STOCK

[75] Inventors: Lee J. Cuddy, Monroeville Borough; Harry H. Podgurski, Greensburg, both of Pa.

[73] Assignee: United States Steel Corporation, Pittsburgh, Pa.

[22] Filed: July 30, 1975

[21] Appl. No.: 600,754

[52] U.S. Cl. ..... 148/16.6; 75/123 B; 148/16

[51] Int. Cl.[2] ..... C21D 1/48

[58] Field of Search ..... 148/16.6, 16.5, 16, 148/13.1, 20.3; 75/14, 123 J, 123 B

[56] References Cited

UNITED STATES PATENTS

| | | | |
|---|---|---|---|
| 2,603,562 | 7/1952 | Rapatz | 75/123 J |
| 3,399,085 | 8/1968 | Knechter et al. | 148/16.6 |
| 3,748,195 | 7/1973 | Kondo et al. | 148/16.5 |
| 3,754,894 | 8/1973 | Saccomano et al. | 75/123 B |
| 3,804,678 | 4/1974 | Kindlimann | 148/16.6 |
| 3,870,572 | 3/1975 | Brugger et al. | 148/16.5 |

*Primary Examiner*—Walter R. Satterfield
*Attorney, Agent, or Firm*—Arthur J. Greif

[57] ABSTRACT

Low carbon, low alloy, ferrous metal stock containing from 0.05 to 0.5 wt. percent uncombined group IVB or VB metal, is strengthened by a procedure comprising; gas phase nitrogenation at temperatures below 590° C to form extremely fine dispersions of such group IVB or VB metal nitrides, followed by an additional treatment for removing excess nitrogen in solid solution.

14 Claims, 5 Drawing Figures

SUBSCALE REACTION STRENGTHENING OF LOW CARBON FERROUS METAL STOCK

This invention relates to a method for strengthening of low carbon ferrous stock by a subscale reaction procedure, and is more particularly related to a process for the production of high-strength parts from ferrous stock such as sheet and thin plate. The process is particularly useful in the forming of complex shapes from relatively low strength deep drawing steels and thereafter hardening by the method disclosed herein.

Carbide and nitride forming transition elements are often added to steel in low concentrations to increase strength by the formation of dispersions of alloy carbides and/or nitrides. In these steels, the carbon and nitrogen are added to the steel melt so that precipitates form during cooling or subsequent heat treatments. Although the resulting low-alloy steels have excellent strength, their formability and toughness are, in general, significantly descreased as a result of the addition of such hardening elements. The latter methods of hardening are to be contrasted with conventional nitriding processes for the surface hardening of steels. Steels useful for such conventional nitriding often contain appreciable levels of carbon (e.g. 0.4%) together with elements such as Al, Cr or Mo which have a strong tendency to form nitrides. When nitrogen is diffused into such a steel, nitride phases form if structural and compositional levels are suitable for their nucleation. When such nitride phases are in a state of extremely fine dispersion, they exert a strain on the surrounding ferrite matrix resulting in marked strengthening (or hardening) of the surface. This hardening, by nitriding, has most often been utilized for case hardening, i.e. for hardening to depths which are relatively small when compared with the thickness of the stock being treated. However U.S. Pat. No. 3,219,494 does show that a similar procedure can be employed on sheet or strip stock, to form an iorn-nitride case, followed by the subsequent diffusion of the nitrogen from the nitrogen-rich case into the central core of the sheet so that upon cooling the sheet may be hardened by the formation of iron nitride. U.S. Pat. No. 3,847,682 also describes a process for the strengthening of sheet stock, containing strong nitride formers selected from Ti, Cb or Zr. Here the formation of iron nitride is avoided, by proper control of the nitrogen activity of the nitriding atmosphere at temperatures between 1100° and 1350° F (593° to 732° C) whereby the resulting fine dispsersions of Ti, Cb or Zr nitrides effect desired strengthening. It has been found however, that such high temperature nitrogenation, as is shown in U.S. Pat. No. 3,847,682, has a number of disadvantages, including (a) difficulty in the control of a desired nitrogen activity, as a result of the thermal dissociation of ammonia, (b) tendency toward blistering - this tendency being especially severe with specimens which have previously been cold rolled, and (c) coarsening of Cb dispersions resulting in loss of strength.

It is therefore a principle object of this invention to provide a process for significantly strengthening low carbon, low alloy ferrous stock.

It is a further object to provide a process for producing sheet stock with a combination of high strength, and good ductility, by the nitrogenation of large masses (eg. 5 – 50 tons) of sheet material.

These and other objects and advantages of the invention will be more apparent from the following description when taken in conjunction with the appended claims and the drawings, in which;

FIGS. 4*a*, *b* and *c* shows the effect of temperature, on the coarsening of TiN, CbN and VN particles respectively, as measured by changes in hardness and resistivity.

Figure 5:
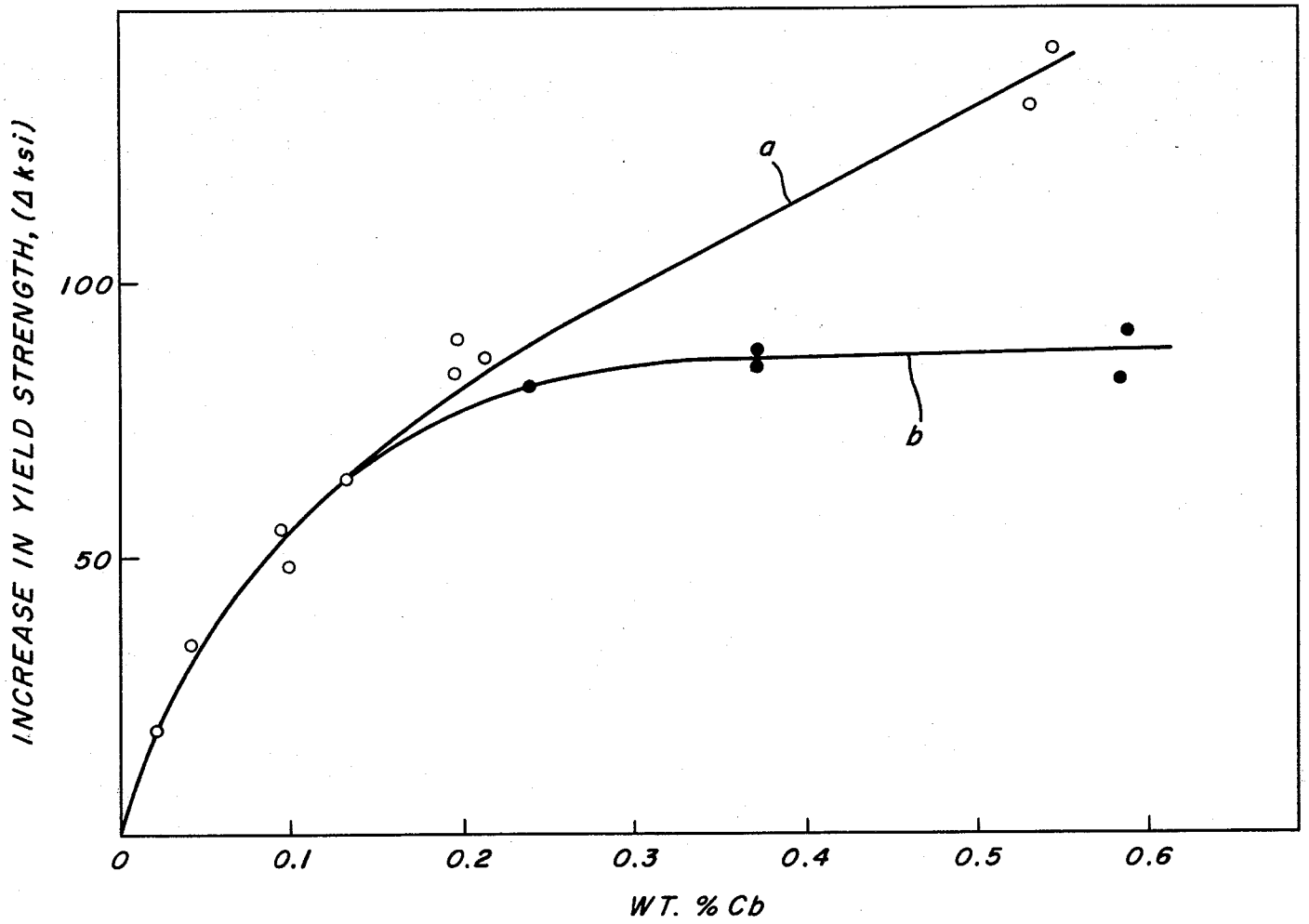

FIG. 5 shows the deleterious effect of the formation of $\epsilon$ phase ($CbFe_2$) prior to nitrogenation in alloys containing in excess of about 0.2% Cb.

As noted above, alloy elements such as Al, Mo, and Cr are conventionally used in heat treatable steels (0.3 to 0.6% C) for case hardening. An investigation into the kinetics of formation of aluminum nitride in recrystallized ferrite, very low in carbon, (H. Podgurski et al, Trans. Met. Soc. of AIME, Vol. 245, pp. 1598–1603, July 1969) has shown the energy barrier to aluminum nitride formation is high. Because of the high solubility product of the nitrides of Mo and Cr in ferrite, concentrations in excess of 0.5 wt. % of these elements are needed to produce significant hardening: in turn, this hardness drops off rapidly with time even at low nitriding temperatures due to rapid particle growth. By contrast, we have found that with respect to the group IVB and VB elements alloyed in ferrite (low carbon), and Ti and Cb in particular, that there exists a very low energy barrier to alloy-nitride formation even at very low concentrations, i.e. those well below 0.5 wt. %. Here, the advancing front in the nitrogenation process moves at a rate dictated by the rate of arrival of nitrogen at the subscale front in the alloy; that is, the rate of the nitride formation is very rapid when compared with the rate of diffusion of nitrogen.

Figure 2:
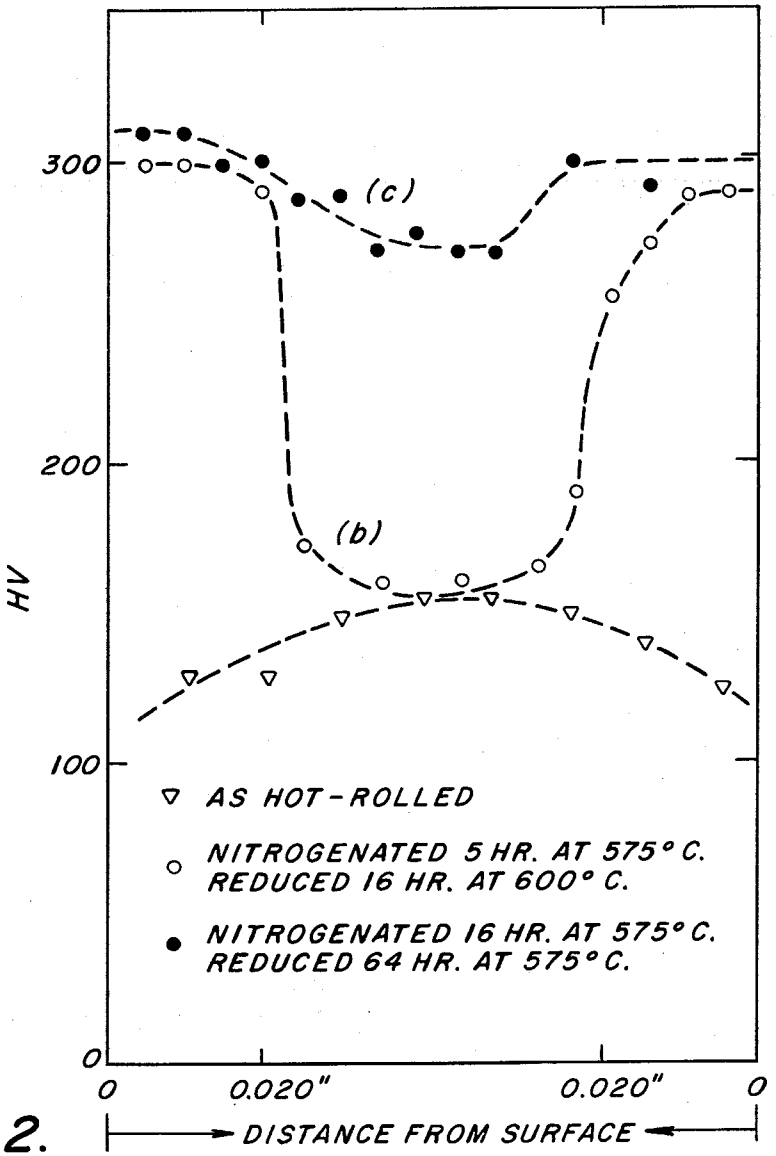
FIG. 2 shows such a subscale front, as detected by hardness measurements, advancing into an 0.085 inch sheet of Fe-0.3%Mn-0.3% Cb.
Figure 1:
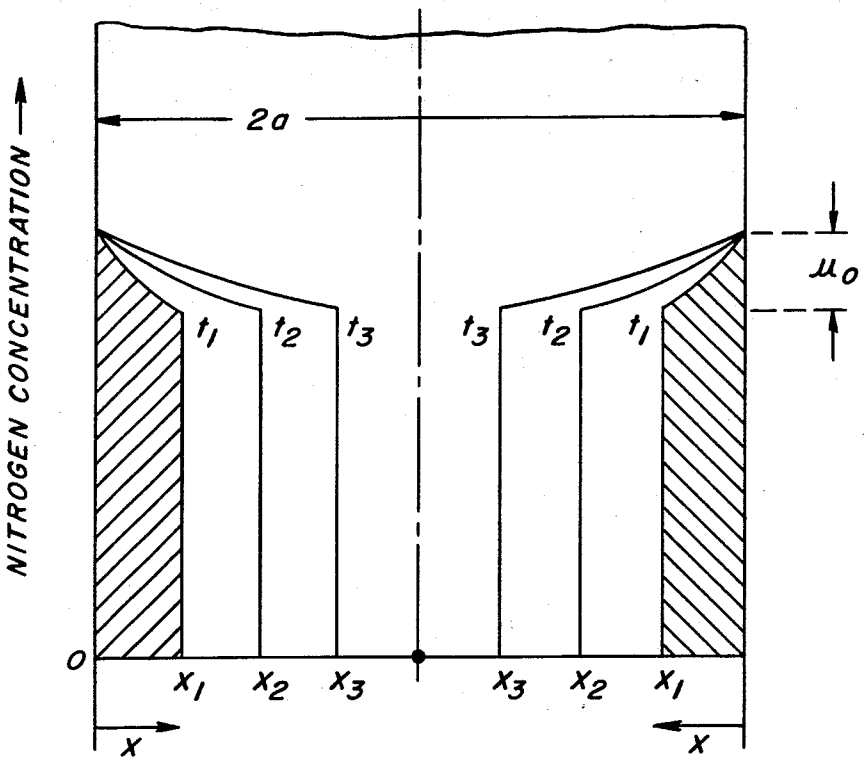
FIG. 1 is a schematic representation of the nitrogen concentration profiles, depicting the advancing subscale front at times $t_1$, $t_2$ and $t_3$, etc.
Figure 3:
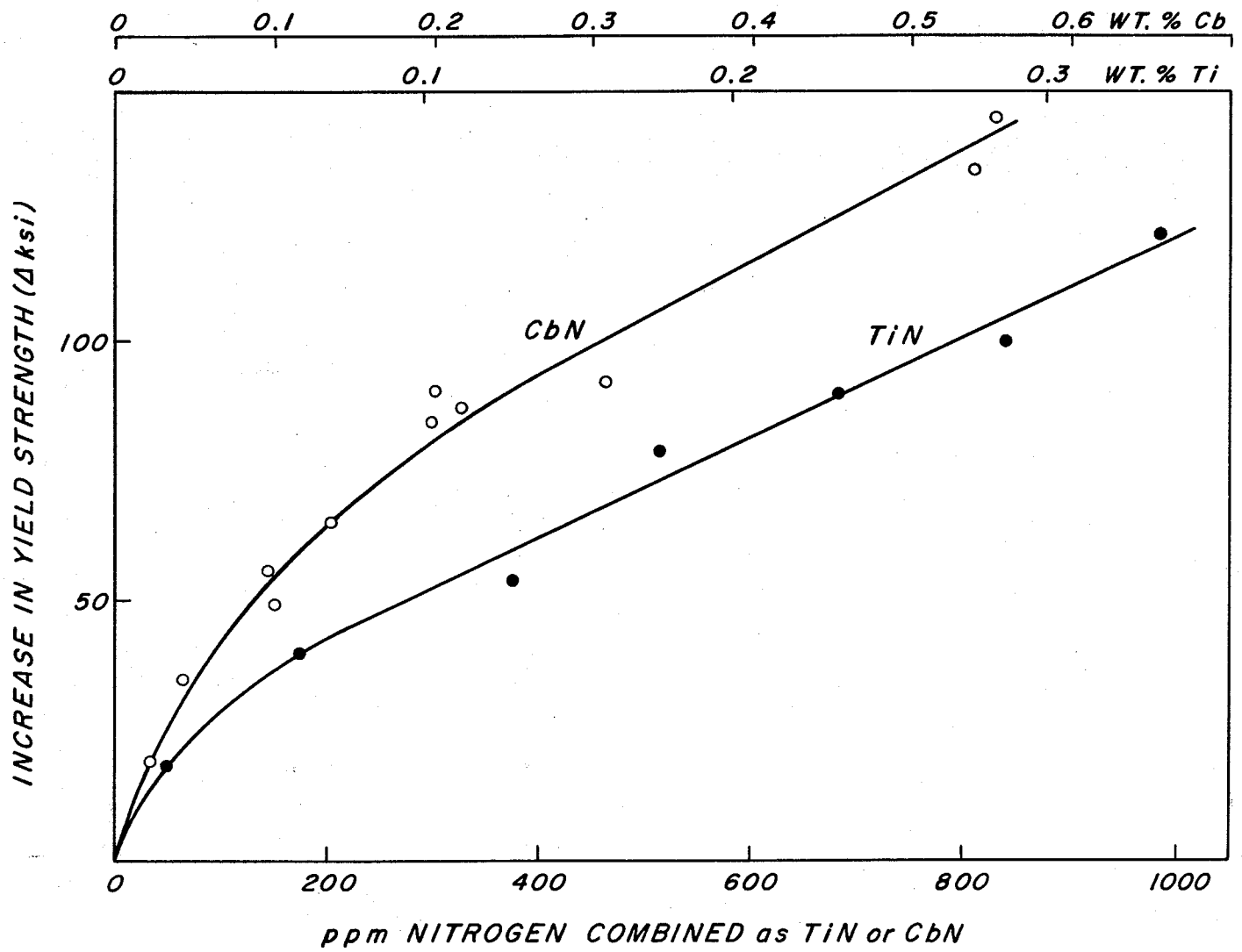
FIG. 3 depicts the marked strengthening provided by fine dispersions of TiN and CbN formed by the present invention.

FIG. 1 depicts a model for diffusion-controlled subscale formation showing nitrogen concentration profiles at times $t_1$, $t_2$ and $t_3$ in a slab in which subscale has formed the depths $x_1$, $x_2$ and $x_3$. An order of magnitude agreement was found to exist between the known rate of diffusion for nitrogen in pure iron at 500° C ($D_N = 3.6 \times 10^{-8}$ cm²/sec) and the rate calculated utilizing this model.* The conclusions as to the rate controlling step, were also borne out by hardness measurements as shown in FIG. 2. The advance of a substantially planar front, or subscale, is clearly evident. Initially, the surface layers are fully hardened by the formation of the alloy-nitride, while the center remains at its original hardness (curve *b*). Only after the nitrogen penetrates to the center (curve *c*) does the hardness increase there. Thus, at relatively low temperatures these group IVB and VB atoms become substantially immobilized as extremely finely dispersed nitrides, allowing for comparatively little particle growth (at temperatures < 590° C). Such extremely fine dispersiona are one of the most effective means for alloy strengthening. The effects of nitrogenation on strength may readily be seen by reference to FIG. 3, wherein the change in yield strength is plotted against the total weight of nitrogen retained in the alloy (i.e. held as TiN or CbN) after removal of substantially all the nitrogen in solid solution. For a given level of nitrogen, the effect of CbN dispersions on strength is seen to be significantly greater than that achieved by similar sheet stock employing only TiN dispersions. Thus, for example, 300 ppm of N combined as CbN provides an increase in yield strength (Δ Y.S.) of about 80 ksi, where the same amount of N combined as TiN produced an increase of about 50 ksi. It should be noted, however, on a weight basis of alloy element (i.e. Cb vs. Ti), that the increase in strength attained is quite similar.

* In commercial nitrogenation treatements the rate can be slowed down somewhat by such poisons as HCN and under these circumstances surface, or mixed surface and diffusion control is experienced. This difficulty can be overcome by a procedure such as taught in U.S. Pat. No. 3,684,590.

While achievement of high strength is significant, it is most often desirable to produce an alloy which combines such strength with good formability and toughness. With respect to these latter two properties, it was found that nitrogenated Cb alloys were generally superior to nitrogenated Ti alloys. The effect of nitrogenation upon the ductility of stock containing Ti as the principle strong nitride forming agent is complex, and was found to depend on (i) the relative concentration of other alloying elements (Mn, Ni), (ii) the temperature of nitrogenation and (iii) the state of the material (cold worked or recrystallized) prior to nitrogenation. Recrystallized Ti alloys containing little or no Mn tended to be embrittled by nitrogenation. For alloys containing less than about 0.25% Ti, the addition of Mn to provide a Mn:Ti ratio of about at least 1.5:1 restored ductility. However, when Ti was in excess of about 0.25%, there existed a tendency to embrittlement even when Mn was present within the preferred range of greater than 0.3% Mn. Ni may be substituted for Mn to reduce the tendency to embrittlement in recrystallized alloys, but significantly greater amounts are required. Therefore, in the nitrogenation at temperatures of 450°–590° C, of alloys in which Ti supplies a major portion of the nitride forming elements (i.e. in which Ti is at least 51% of the total amount of all group IVB and VB elements employed), it is desirable to employ a Mn:Ti weight ratio of at least 1:5 and preferably at least 0.3% Mn. Cold working prior to nitrogenation also produced ductile product, even when essentially no Mn was present. Cold reductions of as little as 10% were found sufficient to produce ductility in otherwise brittle alloys. Additional cold work prior to nitrogenation, increased both the yield and tensile strengths, but had comparatively little effect on improving ductility.

By comparison, alloys containing only Cb as a strong nitride forming element exhibited ductile behavior in the recrystallized state, even when no Mn was present. Here too, however, it was found that ductility was generally improved by the addition of Mn. With respect to Cb containing alloys in particular, it was found that high temperature nitrogenation of alloys, which were not fully recrystallized, produced severe blistering. Thus nitrogenation of sample 26 was halted, short of reaching a higher nitrogen content, because the sample exhibited severe blistering as a result of nitrogenation at a temperature of 650° C.

Figure 4:
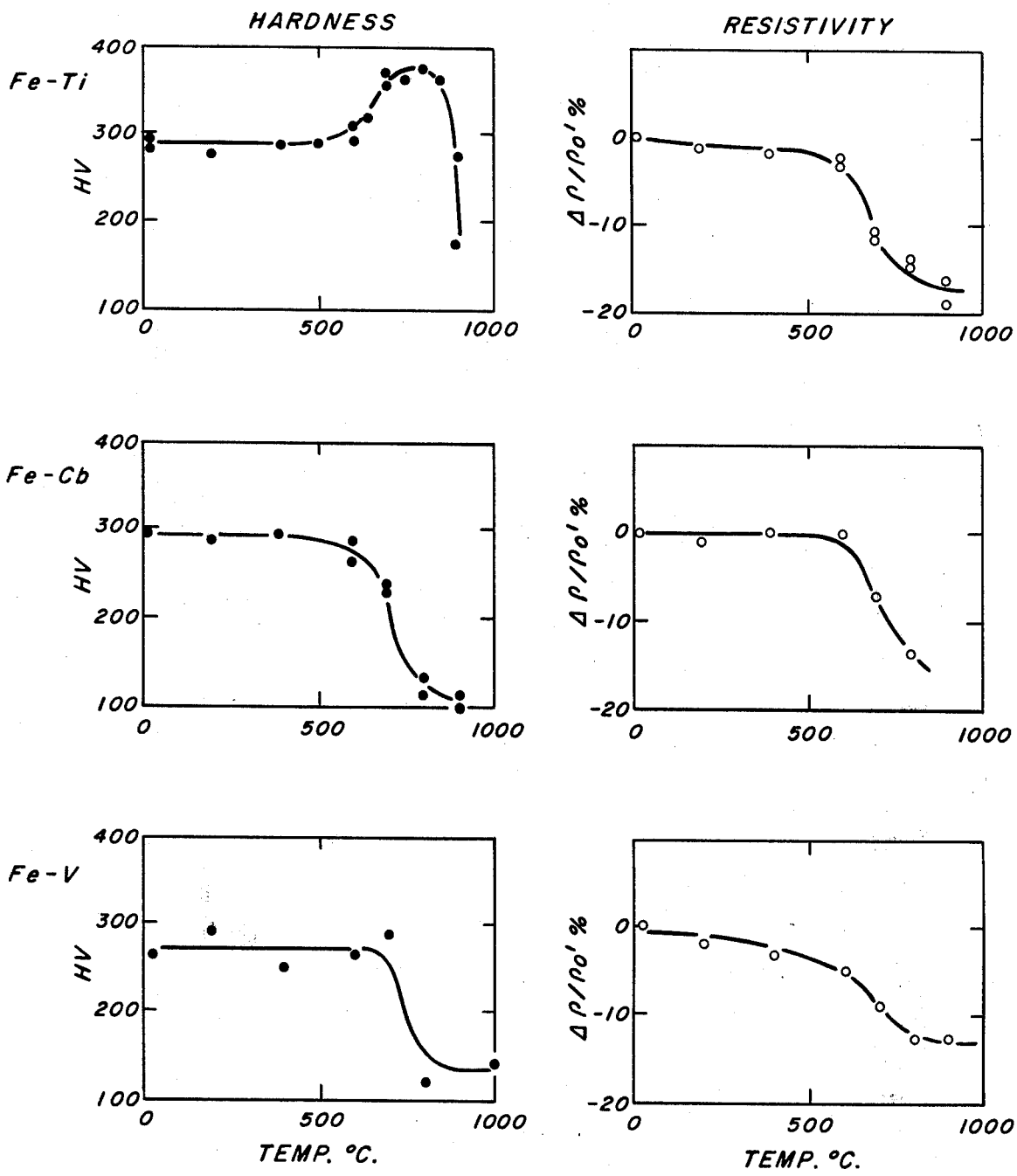

The effectiveness, as strengthening agents, of the dispersions created by nitrogenation is strongly dependent on the size of the dispersed phase. The growth of alloy nitrides may be monitored by examining changes both in hardness and in electrical resistivity. FIG. 4 shows the changes in these properties, for Cb, Ti and V bearing alloys, caused by 1-hour anneals at temperatures of from 200° to 900° C. In all cases resistivity begins to drop after 1 hour at 600° C, apparently reflecting growth of the dispersed phase. In the Cb and V alloys, this change in resistivity is coincident with a drop in hardness. Bhy contrast, in the Ti alloy hardness beings to rise at 600° C, peaks at about 800° C, and thereafter drops markedly. Therefore, with respect to Cb containing alloys in particular, it may be seen in conducting nitrogenation at temperatures of 600° C and above; that the CbN dispersions which have already formed behind the advancing subscale front will tend to grow, even before the Cb in the central core has combined with the diffusing nitrogen, resulting in material softening of the outer regions. Therefore, in the nitrogenation of alloys in which Cb supplies a major portion of the groups IVB and VB elements (and especially those in which Cb is the priniciple element i.e., in which Cb is at least 90% of the total of the group IVB and VB elements), it is preferable that both nitrogenation and any subsequent treatment for the removal of excess nitrogen in solid solution, be conducted at temperatures not greater than 590° C.

On the other hand, with respect to alloys in which Ti is the major element (and especially those in which Ti is the principle element) it is preferable that nitrogenation be conducted at temperatures below 590° C, while the subsequent removal treatment, if any, could be conducted at temperatures within the range 450° – 850° C, preferably 600° – 800° C. Since any such removal treatments would necessarily employ atmospheres with extremely low nitrogen activities; the aforementioned difficulties, of proper atmosphere control and blistering, would be of no concern. As noted above, for most commercial applicatins, it is desirable that the stock exhibit good formability in combination with high strength. By referring to Table I, it may be seen that the bulk of the alloys (excepting those with yield strengths in excess of about 150 ksi) exhibited elongations within the range 10 to 20%. It was found, however, that elongation was not a consistent measure of formability. Therefore, formability was evaluated by a rapid, 90°, reverse bend test in which bends of ≈ lt were made at 45° to the rolling direction. Samples were rated POOR, GOOD or EXCELLENT according to whether they respectively: cracked during the first 90° bend; withstood the first 90° bend plus one 180° reverse bend; withstood at least one additional reverse bend cycle. It was found that formability, as measured by this test, correlated well with reduction-in-area (R/A) measurements. Thus, nitrogenated specimens with R/A ≥ 60%, exhibited EXCELLENT bendability. Those with a R/A between 20 and 60% rated GOOD and those with an R/A below 20 were consistently POOR.

Depending on end use, the teachings of this invention may be employed to provide low carbon product with a wide variety of mechanical properties, eg. from (a) product having yield strengths in the range 200 to 280 ksi coupled with elongations below about 5% to (b) product with yield strengths of the order of 50 ksi coupled with excellent formability and toughness. The desired mechanical properties of the end product will, to a large extent, govern both the choice of starting material and the particular treatment employed. It is, however, essential that the initial stock be composed of an alloy containing, from 0.05 to 0.5 wt. % of an available group IVB or VB element. Of these, it is preferable that a principle portion thereof be supplied by Ti and/or Cb; and more preferably with a major portion being supplied by Cb. The term "available" as used herein, denotes that amount of the element which is uncombined and therefore capable of reacting with the nitrogen subsequently added by solid-state diffusion from an external source, eg. by gas-phase nitrogenation. Since any carbon, nitrogen or oxygen present in the melt will tend to combine with the strong nitride former, and thus decrease the amount available, it is desirable that these elements respectively be limited to 0.02% max, carbon. 0.02% max. nitrogen and 200 ppm oxygen, and preferably 0.01% max, carbon, 0.01% max, N, and 100 ppm oxygen. To enhance ductility, Mn may be included in the proportions described above. Similarly, when ductility is of prime concern, it is desirable that the total amount of nitride former be limited to about 0.25%; except when Cb is the principle element, in which case about 0.4% Cb may be employed.

It should be noted that the achievement of hardening by the formation of alloy-nitride dispersions, is initially dependent on the state of dispersion of the nitride forming element. It is therefore desirable that steps be taken to assure that the nitride forming element is in solid solution in the ferrite prior to nitrogenation. This is particularly critical with respect to Cb and Zr, since it was found that at levels above about 0.2% that Cb or Zr tended to precipitate as $\epsilon$ phase. Therefore, at Cb (or Zr) levels above 0.2%, maximum hardening may be achieved by rapidly cooling the stock from temperatures at which essentially all the Cb is in solid solution, so as to maintain the Cb in solid solution. Thereafter, the stock should be nitrogenated, prior to the occurrence of a significant amount of aging, i.e. precipitation of Cb. FIG. 5 provides a comparison of alloys containing varying concentrations of Cb, showing the effect on strength of alloys in which essentially all the Cb was in solid solution prior to nitrogenation (curve *a*) vs. alloys in which the Cb was permitted to precipitate out prior to nitrogenation (curve *b*).

Nitrogenation is thereafter conducted at temperatures of 450° – 590° C, preferably 500° – 590° C, in an atmosphere having a nitrogen activity sufficient to effect the diffusion of nitrogen into the stock but below that which will form iron nitride. Examples of such atmospheres and the determination of nitrogen acticity are shown, for example, in U.S. Pat. No. 3,399,085, the disclosure of which is incorporated herein by reference. Within the temperature range of 500° – 590° C, nitrogen activities varying respectively, from about 0.22 to 0.16 are particularly perferred. The initial stock may be nitrogenated in the hot-rolled or recrystallized state. However, the present strengthening process is particularly applicable to the production of high strength parts from sheet or light plate which is formed to the desired shape and then hardened. Thus, even complex shapes may be formed from comparatively deep drawable stock and then hardened by the instant method. Examples of such parts include high-strength containers, bumpers and door stiffeners for automotive use and a wide variety of aircraft parts.

Material strengthening is achieved by diffusion of a nitrogen subscale front which is at least 25% of the thickness of the stock. In the case of sheet or plate stock, the nitrogen will generally be diffused simultaneously from both planar surfaces, so that the subscale front will amount to at least 50% of the sheet thickness; i.e. at least 25% from each surface. Maximum strength will, of course, be realized by through-hardening, in which nitrogen is diffused substantially to the center core of the sheet. This does not, however, require that the nitrogenation treatment be conducted to diffuse the subscale front to center of the sheet. Thus, total treatment time (for nitrogenation and subsequent removal of excess nitrogen in solid solution) may somewhat be decreased, by terminating nitrogenation before the subscale front has been diffused to the final desired extent. Thereafter, during removal of the excess nitrogen, the ambient atmosphere is controlled so that a portion of the nitrogen remaining in solution (uncombined nitrogen in the nitrided region) diffuses toward the un-nitrided region at the center. Thus, if it is desired to through-harden the sheet by saturating the nitride forming elements at the center thereof, nitrogenation can be conducted for a period of time sufficient to diffuse the subscale front (from each planar surface) to a distance which is less then 49%* of the sheet thickness, followed by a removal treatment in which the solid solution nitrogen diffuses inwardly to saturate the remaining central portions thereof. In this regard, it should be noted that removal of excess nitrogen, i.e. nitrogen in solution in ferrite, is highly desirable; since such excess nitrogen will tend to embrittle the allloy by the formation of iron nitride precipitates during cooling to room temperature. Removal may be achieved in a variety of reducing atmospheres (eg. $H_2$, $N_2 + H_2$) wherein the activity of nitrogen is sufficiently low, generally below 0.002 atm. $^{-1/2}$, to remove at least a major portion of the dissolved nitrogen from the stock.

*Note - it is not possible to prescribe the exact extent to which the subscale need be diffused, since this is dependent on the amount of available nitride former, the temperature of the removal treatment, etc. However, the progress of nitrogenation or depth of subscale front can easily be followed by such methods as (i) measuring weight gain, (ii) chemical analysis, or (iii) making hardness profiles, of small test specimens which are easily removable from a nitriding furnace through a gas lock.

As an alternative to a removal treatment in a reducing atmosphere, the total treatment time can more significantly be reduced by the utilization of a non-reducing atmosphere which prevents the escape of free nitrogen from the outer surface of the stock. Since nitrogen can only escape either by the formation of $NH_3$ or by the formation of $N_2$, a variety of atmospheres may be employed. For example, any atmosphere which is devoid of $H_2$ will prevent the formation $NH_3$. On the other hand, the formation of $N_2$ may easily be prevented by contamination of the stock surface, eg. by causing surface oxidation utilizing an atmosphere containing traces of water and/or oxygen. By utilizing such atmospheres which prevent the excape of nitrogen, the above-noted uncombined nitrogen will continue to diffuse toward the interior (since it cannot escape the free surface of the stock) or core until it has been irreversibly consumed in advancing the subscale front. Thus, this latter preferred procedure serves the dual purpose of accomplishing (i) further nitrogenation of the core while (ii) effecting removal of excess solid solution nitrogen which tends to embrittle the alloy on subsequent cooling. Clearly, this latter procedure may also be effectively employed to reduce total treatement time, in situations in which through-hardening to the core is not needed.

TABLE I

| Sample No. | Composition | Treatment: Anneal (° C)-(hr) or Cold Roll (CR) | Nitrogenation ° C | Nitrogenation $a_N$ | Nitrogenation hr | Reduction ° C | Reduction $a_N$ | Reduction hr | Nitrog. Gain ppm | Mechanical Properties: Y.S. ksi | T.S. ksi | Elong. % | R/A % | Bend |
|---|---|---|---|---|---|---|---|---|---|---|---|---|---|---|
| 1 | .58 Ti | CR | 500 | .24 | 50 | 500 | .04 | 20 | 2760 | 258 | 262 | 2.0 | | — |
| 2 | .58 Ti | 600 0.5 | 500 | .25 | 20 | 525 | 0 | 70 | 2493 | 222 | 222 | 4.4 | | — |
| 3 | .23 Ti | CR | 500 | .24 | 18 | 600 | 0 | 3 | 983 | 160 | 161 | 3.2 | | — |
| 4 | .17 Ti | CR | 500 | .27 | 18 | 600 | 0 | 3 | 594 | 118 | 135 | 12 | | — |
| 5 | .17 Ti | 950 0.5 | 500 | .26 | 17 | 600 | 0 | 24 | — | Brittle | | | | — |
| 6 | .29Ti, .52Mn | CR | 500 | .26 | 21 | 600 | 0 | 8 | 1080 | 174 | 196 | 10 | | P |
| 7 | .29Ti, .52Mn | 720 2 | 500 | .27 | 19 | 600 | 0 | 8 | 994 | Brittle | | | | P |
| 8 | .29Ti, .52Mn | 720 + 10% CR | 500 | .27 | 19 | 600 | 0 | 8 | 994 | 137 | 160 | 11 | | P |
| 9 | .29Ti, .52Mn | 720 + 20% CR | 500 | .27 | 19 | 600 | 0 | 8 | 994 | 145 | 167 | 11 | | P |
| 10 | .29Ti, .52Mn | 720 + 40% CR | 500 | .27 | 19 | 600 | 0 | 8 | 994 | 144 | 178 | 14 | | P |
| 11 | .23Ti, .85Mn | 800 1 | 500 | .27 | 18 | 600 | 0 | 8 | 841 | 117 | 148 | 18 | | P |
| 12 | .2 Ti, .3 Mn | CR | 500 | .25 | 19 | 500 | .03 | 22 | 1070 | 160 | 160 | 4.7 | | — |
| 13 | .2 Ti, .3 Mn | 700 .7 | 575 | .14 | 3 | 600 | .03 | 1.5 | 763 | 109 | 139 | 15 | | P |
| 14 | .2 Ti, .3 Mn | 700 + 10% CR | 575 | .14 | 3 | 600 | .03 | 1.5 | 735 | 115 | 143 | 13 | | P |
| 15 | .2 Ti, .3 Mn | 700 + 20% CR | 575 | .14 | 3 | 600 | .03 | 1.5 | 786 | 120 | 146 | 12 | | P |
| 16 | .2 Ti, .3 Mn | 700 40% CR | 575 | .14 | 3 | 600 | .03 | 1.5 | 840 | 134 | 157 | 12 | | P |
| 17 | .19Ti, .39Mn | 800 1 | 500 | .26 | 17 | 600 | 0 | 8 | 502 | 91 | 116 | 15 | | G |
| 18 | .19Ti, .39Mn | 800 1 | 500 | .25 | 17 | 600 | 0 | 8 | 510 | 91 | 117 | 16 | | G |
| 19 | .19Ti, .44Mn | 800 1 | 500 | .25 | 19.5 | 600 | 0 | 8 | 679 | 102 | 114 | 17 | | P |
| 20 | .08Ti, .42Mn | CR | 500 | .26 | 21 | 600 | 0 | 8 | 170 | 103 | 114 | 8.4 | | G |
| 21 | .08Ti, .42Mn | 800 1 | 500 | .27 | 17 | 600 | 0 | 6 | 173 | 53 | 79 | 19 | | G |
| 22 | .32Ti, .45Mn, 7.8 Ni | 700 1 | 500 | .27 | 22 | 600 | 0 | 7 | 956 | 151 | 176 | 7.3 | | E |
| 23 | .3 Ti, 3.0Ni | 660 2 | 575 | .12 | 16 | 600 | .023 | 2 | 1376 | 172 | Brittle | | | — |
| 24 | .2 Ti, 3.0Ni | 660 2 | 575 | .12 | 16 | 600 | .023 | 2 | 844 | 130 | 144 | 4.4 | | — |
| 25 | .31 Cb, .13Mn | 700 2 | 500 | .27 | 20 | 500 | 0 | 6.5 | 370 | 107 | 124 | 11 | | — |
| 26 | .31 Cb, .13Mn | 700 2 | 650 | .06 | 2.25* | 650 | 0 | 2.5 | 264 | 88 | 107 | 9 | | — |
| 27 | .2 Cb | 800 1 | 500 | 0.26 | 22 | 600 | 0 | 24 | ~ 200 | 77 | 105 | 13 | | G |
| 28 | .4 Cb | 800 1 | 500 | 0.26 | 7 | 600 | 0 | 16 | 461 | 107 | 140 | 11 | | G |
| 29 | .3 Cb, .30Mn | 800 1 | 500 | 0.26 | 18 | 600 | 0 | 24 | 353 | 90 | 111 | 9 | 72 | E |
| 30 | .3 Cb, .33Mn | Hot Rolled | 500 | 0.25 | 5 | 600 | 0 | 16 | 312 | 88 | 113 | 12 | 77 | E |
| 31 | .08Cb, .3 Mn | 1300 0.1 | 500 | 0.25 | 5 | 600 | 0 | 16 | ~ 35 | 34 | 47 | 14 | 95 | E |
| 32 | .14 V, .61Mn | 720 19 | 500 | 0.25 | 18 | 600 | 0 | 23 | ~ 145 | 68 | 87 | 12 | 77 | E |

*Blistered

We claim:

1. A process for the diffusion-reaction strengthening of ferrous metal stock consisting essentially of, in wt. %, 0.001 to 0.02% carbon, 0.02 max. % nitrogen, 0.02 max. % oxygen, 0.05 to 0.5% available strong nitride forming metal, selected from the group IVB and VB elements and mixtures thereof, with the balance iron and residual steelmaking elements, which comprises, at a temperture within the range of 450° to 590° C, nitrogenating said stock for a time at least sufficient to diffuse a nitride subscale front to a distance from a stock surface, which is at least 25% of the thickness of said stock, said nitrogenation being conducted in an atmosphere having a nitrogen activity (i) sufficient to diffuse nitrogen into said stock and form said subscale front, but (ii) below that which will lead to the formation of iron nitride during said nitrogenation.

2. The method of claim 1, wherein said stock is in the form of sheet, and said nitrogenation is conducted to simultaneously diffuse nitrogen from the planar surface of the sheet and thereby form two subscale fronts, each to a distance of from 25 to 50% of the sheet thickness, from their respective planar surfaces.

3. The method of claim 2, wherein subsequent to nitrogenation, the stock is treated in an atmosphere having a nitrogen activity below that which is in equilibrium with excess nitrogen in solid solution in the ferrous metal, this subsequent treatment being conducted at a temperature within the range of 500° – 800° C, the time and temperature being selected to remove a major portion of the excess solid solution nitrogen and to an extent sufficient to prevent embrittlement by the formation of iron nitride during the cooling of said nitrogenated stock to room temperature, said temperature being below that which will lead to undesirable softening of the nitrogenated stock.

4. The method of claim 2, wherein said nitrogenation is conducted to diffuse each of said two subscale fronts to a distance which is less than 49% of the sheet thickness, and subsequent to nitrogenation, the stock is treated at a temperature in the range of 500°–800° C in an atmosphere which essentially prevents the escape of solid solution nitrogen from the free surface of said stock, whereby the solid solution nitrogen is diffused towards the core portion of the stock to form nitrides with the yet uncombined strong nitride forming elements in said core portion, said temperature being below that which will lead to undesirable softening of the nitrogenated stock.

5. The method of claim 3, in which said stock contains at least 0.1% of said nitride forming metal and wherein the major portion of said nitride forming metal is supplied by Cb, said subsequent treatment being conducted at temperatures below 590° C.

6. The method of claim 4, in which said stock contains at least 0.1% of said nitride forming metal and wherein the major portion of said nitride forming metal is supplied by Cb, said subsequent treatment being conducted at temperatures below 590° C.

7. The method of claim 5, in which said stock prior to nitrogenation contains 0.01 max. % nitrogen and greater than about 0.2% Cb, wherein said stock is rapidly cooled from a temperature at which essentially all the Cb is solid solution so as to prevent the precipitation of Cb as coarse dispersions of $\epsilon$ phase and said stock is thereafter nitrogenated before the occurrence of a significant degree of aging.

8. The method of claim 6, in which said stock prior to nitrogenation contains 0.01 max. % nitrogen and greater than about 0.2% Cb, wherein said stock is rapidly cooled from a temperature at which essentially all the Cb is solid solution so as to prevent the precipitation of Cb as coarse dispersions of $\epsilon$ phase, and said stock is thereafter nitrogenated before the occurrence of a significant degree of aging.

9. The method of claim 3, in which said stock contains up to 1.0% Mn and in which the ratio of Mn to strong nitride forming element is at least 1.5:1.

10. The method of claim 9, wherein prior to nitrogenation the stock is cold-reduced to a reduction in thickness of at least 10%.

11. The method of claim 10, wherein the principle portion of said strong nitride forming metal is supplied by Ti, and Mn is present in an amount of at least 0.3%.

12. The method of claim 11, wherein said nitrogenation is conducted to diffuse each of said two subscale fronts to a distance which is less than 49% of the sheet thickness, and subsequent to nitrogenation, the stock is treated at a temperature in the range 500°–800° C in an atmosphere which essentially prevents the escape of solid solution nitrogen from the free surface of said stock, whereby the solid solution nitrogen is diffused towards the core portion of the stock to form nitrides with the yet uncombined strong nitride forming elements in said core portion.

13. The method of claim 12, wherein Ti is less than 0.25%.

14. The method of claim 3, in which said stock contains greater than about 0.2% Zr, wherein said stock is rapidly cooled from a temperature at which essentially all the Zr is in solid solution, so as to prevent the precipitation of Zr as coarse dispersions of $ZrFe_2$, and said stock is thereafter nitrogenated prior to the occurrence of a significant amount of aging.

* * * * *